US012228328B2

(12) United States Patent
Jackson et al.

(10) Patent No.: US 12,228,328 B2
(45) Date of Patent: Feb. 18, 2025

(54) REFRIGERATED DEVICE WITH ENHANCED CONDENSATE EVAPORATION

(71) Applicant: ILLINOIS TOOL WORKS INC., Glenview, IL (US)

(72) Inventors: Steven T. Jackson, Fort Worth, TX (US); Austin M. Bieri, Burleson, TX (US); Henry L. Nguyen, Haltom City, TX (US); Joseph F. Sanders, North Richland Hills, TX (US)

(73) Assignee: ILLINOIS TOOL WORKS INC., Glenview, IL (US)

( * ) Notice: Subject to any disclaimer, the term of this patent is extended or adjusted under 35 U.S.C. 154(b) by 424 days.

(21) Appl. No.: 17/480,479

(22) Filed: Sep. 21, 2021

(65) Prior Publication Data

US 2022/0090842 A1 Mar. 24, 2022

Related U.S. Application Data

(60) Provisional application No. 63/082,687, filed on Sep. 24, 2020.

(51) Int. Cl.
*F25D 21/14* (2006.01)

(52) U.S. Cl.
CPC ..... *F25D 21/14* (2013.01); *F25D 2321/1412* (2013.01)

(58) Field of Classification Search
CPC ..... F25D 21/14; F25D 2321/1412; F25D 2321/141; F25D 2321/144;
(Continued)

(56) References Cited

U.S. PATENT DOCUMENTS 1,537,601 A 5/1925 Groh
3,111,818 A 11/1963 Dolan et al.
(Continued)

FOREIGN PATENT DOCUMENTS

JP H11-108537 * 4/1999 ..... F25D 2321/1412
JP H11281231 * 10/1999 ..... F25D 23/003
(Continued)

OTHER PUBLICATIONS

English language translation of WO2021/047571. Translated Nov. 2023. (Year: 2021).*
(Continued)

*Primary Examiner* — Cassey D Bauer
(74) *Attorney, Agent, or Firm* — THOMPSON HINE LLP

(57) ABSTRACT

A refrigerated device is configured to enhance condensate evaporation and includes a compartment including an access door, a refrigeration circuit for cooling the compartment, the refrigeration circuit including an evaporator coil and a condenser with an associated condenser fan, and a condensate pan for capturing condensate from the evaporator coil. At least one first air flow path is provided from a pressure side of the condenser fan, into and along at least part of the condensate pan and then to a suction side of the condenser fan. At least one second air flow path is provided from the pressure side of the condenser fan, into and along at least part the condensate pan and then back to the pressure side of the condenser fan.

10 Claims, 6 Drawing Sheets

(58) Field of Classification Search
CPC ..... F25D 2321/1411; F25D 2321/1413; F25D 2321/1441; F24F 2013/225
See application file for complete search history.

(56) References Cited

U.S. PATENT DOCUMENTS

| | | | |
|---|---|---|---|
| 3,421,338 | A | 1/1969 | Gidseg |
| 3,486,347 | A | 12/1969 | Gidseg |
| 3,707,851 | A | 1/1973 | McAshan, Jr. |
| 3,736,765 | A | 6/1973 | O'Dell |
| 4,089,187 | A | 5/1978 | Schumacher et al. |
| 4,783,971 | A | 11/1988 | Alba |
| 4,882,911 | A | 11/1989 | Immel |
| 4,918,940 | A | 4/1990 | Buckley |
| 4,979,377 | A | 12/1990 | Fievet et al. |
| 5,341,653 | A | 8/1994 | Tippmann et al. |
| 5,966,958 | A | 10/1999 | Maynard |
| 6,085,539 | A | 7/2000 | Meyer |
| 6,437,851 | B2 | 8/2002 | Hagiwara |
| 6,701,739 | B2 | 3/2004 | Morse |
| 6,883,336 | B2 | 4/2005 | Dudley et al. |
| 7,065,977 | B2 | 6/2006 | Upton et al. |
| 7,107,786 | B2 | 9/2006 | Manole |
| 7,228,698 | B2 | 6/2007 | Sanders |
| 10,323,875 | B2 | 6/2019 | Sanders |
| 2003/0230104 | A1 | 12/2003 | Morse |
| 2004/0060319 | A1 | 4/2004 | Wood |
| 2004/0079105 | A1 | 4/2004 | Wood |
| 2004/0211212 | A1 | 10/2004 | Wood |
| 2017/0020305 | A1* | 1/2017 | Fischer ..... F25D 21/14 |

FOREIGN PATENT DOCUMENTS

| | | | | |
|---|---|---|---|---|
| JP | 2001-1133129 | * | 5/2001 | ..... F25D 23/003 |
| WO | WO2021047571 | * | 3/2021 | ..... F25D 21/14 |

OTHER PUBLICATIONS

English language translation of JPH11281231. Translated Nov. 2023. (Year: 1999).*
English language translation of JP2001133129. Translated Nov. 2023. (Year: 2001).*
English language translation of JPH11108537. Translated Nov. 2023. (Year: 1999).*

* cited by examiner

REFRIGERATED DEVICE WITH ENHANCED CONDENSATE EVAPORATION

TECHNICAL FIELD

This application relates generally to refrigerated devices, such as refrigerator units and freezer units and, more specifically, to enhanced condensate evaporation in such units.

BACKGROUND

Refrigerators are used in numerous settings, such as in a commercial setting or in a domestic setting. Typically, refrigerators are used to store and maintain food products by providing a cooled environment into which the products can be stored. Refrigeration systems typically include a refrigerated cabinet into which the food products are placed and a refrigeration assembly for cooling the air and products in the refrigerated cabinet. The refrigeration assembly often includes an evaporator assembly and a condenser assembly, each forming a portion of a refrigerant loop or circuit. A refrigerant is used to carry heat from air within the refrigerated cabinet to the ambient environment surrounding the refrigerated cabinet. The refrigerant absorbs heat in the evaporator assembly and then rejects the absorbed heat in the condenser assembly.

Condensate on the evaporator coils may freeze, and such frost may accumulate on evaporator coils of the evaporator assembly, which decreases the efficiency of the refrigeration assembly. Defrosting cycles are typically utilized to remove the frost from the evaporator coils. Once frost has been removed from the evaporator coils, the defrost water or condensate may be transferred to a condensate pan where it may accumulate and be evaporated to ambient environment.

Certain operating environments, specifically those with higher dew points and larger numbers of door openings to the cabinet, lead to more condensate and more frost build-up on the evaporator coils. When a defrost operation takes place, the duration is long and an excessive amount of water egresses from the interior of the cabinet to the condensate pan. If the amount of defrost water is more than the capacity of the condensate pan, the pan will overflow, which is undesirable.

FIGS. 1-3 show a prior art system in which the condensate pan 202 is located below the condenser unit assembly 200, which includes the condenser 204 and a fan 206 for moving air across the condenser, per arrows 207. The floor 210 of the assembly includes two openings 212 and 214 to the condenser pan 202, which enables some limited air flow through the pan, with both openings 212, 214 axially located on the high-pressure side (downstream relative to air flow) of the fan 206. As seen in FIG. 3, the air flow below the floor 210 and above the pan is fairly limited (e.g., about 7 CFM). A hot gas loop 220 of the refrigerant path is located in the condensate pan to heat the condensate for increasing the evaporation rate. U.S. Pat. No. 7,228,698 discloses a prior art arrangement in which part of the condensate pan is exposed to the ambient environment.

SUMMARY

In one aspect, a refrigerated device includes a compartment including an access door. A refrigeration circuit for cooling the compartment includes an evaporator coil with an associated evaporator fan and a condenser with an associated condenser fan. A condensate pan is provided for capturing condensate from the evaporator coil. The condensate pan is part of a condenser unit that includes the condenser and the condenser fan, with the condensate pan locate below a floor of the condenser unit. The floor includes at least one air flow opening to the condensate pan on a high-pressure side of the condenser fan and at least one air flow opening to the condensate pan on a suction side of the condenser fan.

In another aspect, a refrigerated device includes a compartment including an access door, a refrigeration circuit for cooling the compartment, the refrigeration circuit including an evaporator coil and a condenser with an associated condenser fan, and a condensate pan for capturing condensate from the evaporator coil. At least one first air flow path is provided from a pressure side of the condenser fan, into and along at least part of the condensate pan and then to a suction side of the condenser fan. At least one second air flow path is provided from the pressure side of the condenser fan, into and along at least part the condensate pan and then back to the pressure side of the condenser fan.

In a further aspect, a method is provided for enhancing condensate evaporation in a refrigerated device that includes a compartment, a refrigeration circuit for cooling the compartment, the refrigeration circuit including an evaporator coil and a condenser with an associated condenser fan, and a condensate pan for capturing condensate from the evaporator coil. The method involves: during operation of the condenser fan, flowing some air from a pressure side of the condenser fan, into and along at least part of the condensate pan and back to the suction side of the condenser fan. The method may further involve: during operation of the condenser fan, flowing some air from the pressure side of the condenser fan, into and along at least part of the condensate pan and back to the pressure side of the condenser fan.

The details of one or more embodiments are set forth in the accompanying drawings and the description below. Other features, objects, and advantages will be apparent from the description and drawings, and from the claims.

DETAILED DESCRIPTION

FIGS. 4-8 show a refrigerated device 10 (refrigerator and/or freezer) with a cabinet 12 defining one or more internal compartments 14 that are cooled, with one or more doors 16 providing compartment access.

Figure 1:
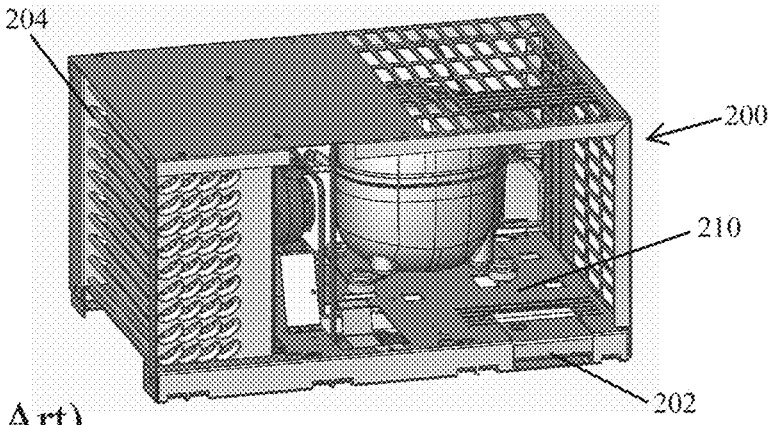
Fig. 1 (Prior Art)
FIGS. 1 and 2 show a prior art condenser unit of a refrigerated device.
Figure 2:
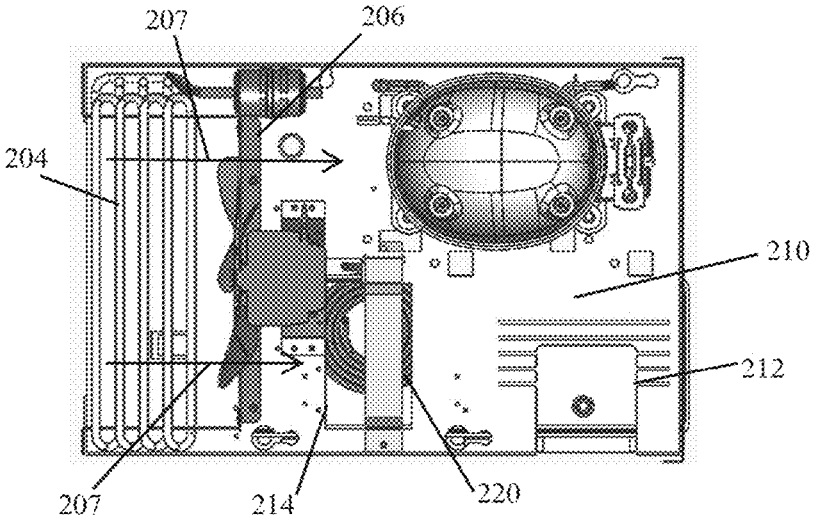
Fig. 2 (Prior Art)
Figure 3:
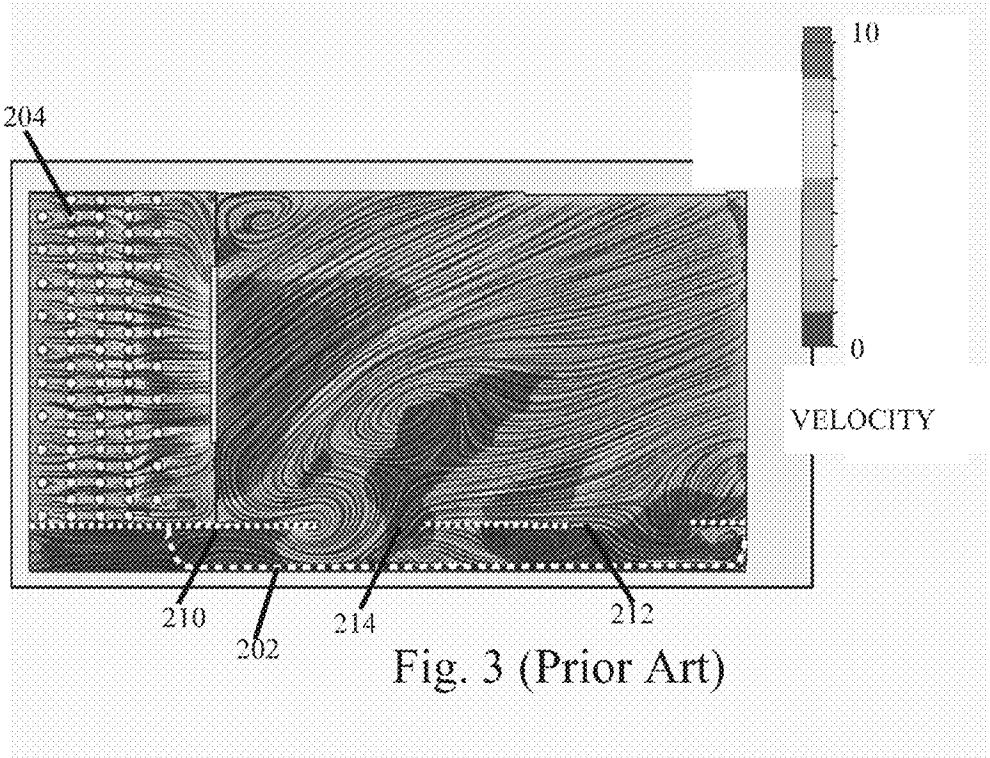
Fig. 3 (Prior Art)
FIG. 3 shows an exemplary air flow within the prior art condenser unit, in side elevation.
Figure 4:
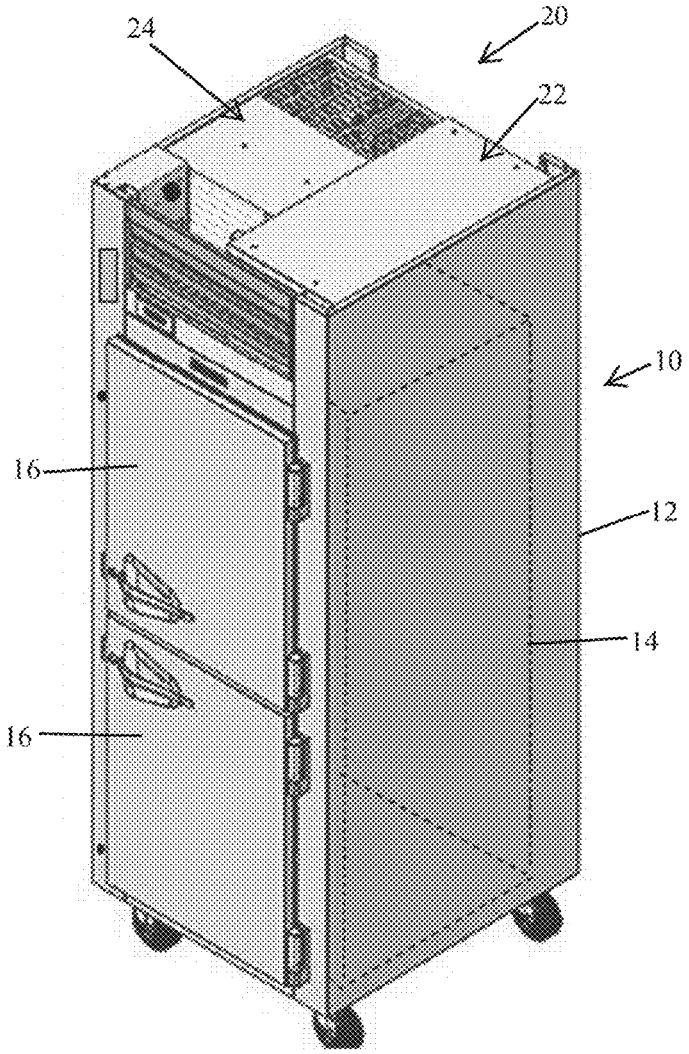
FIG. 4 shows an exemplary refrigerated device of the present application.
Figure 5:
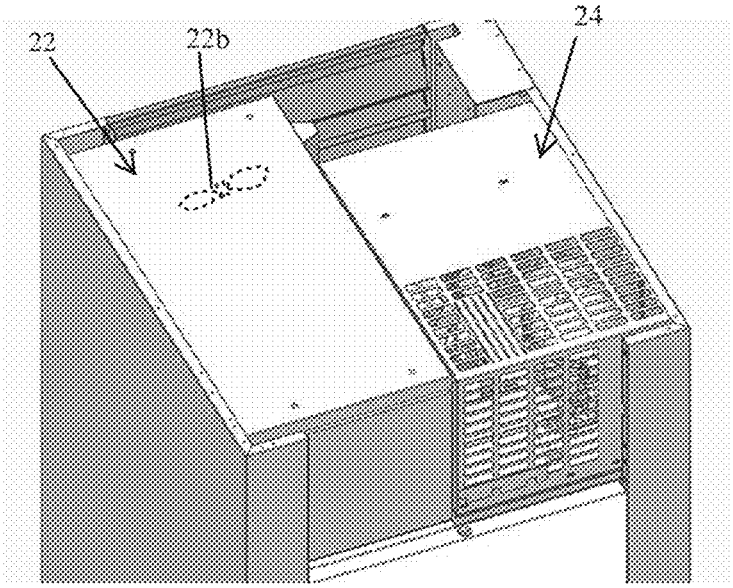
FIGS. 5 and 6 show an evaporator unit and condenser unit atop the refrigerated device of FIG. 4.
Figure 6:
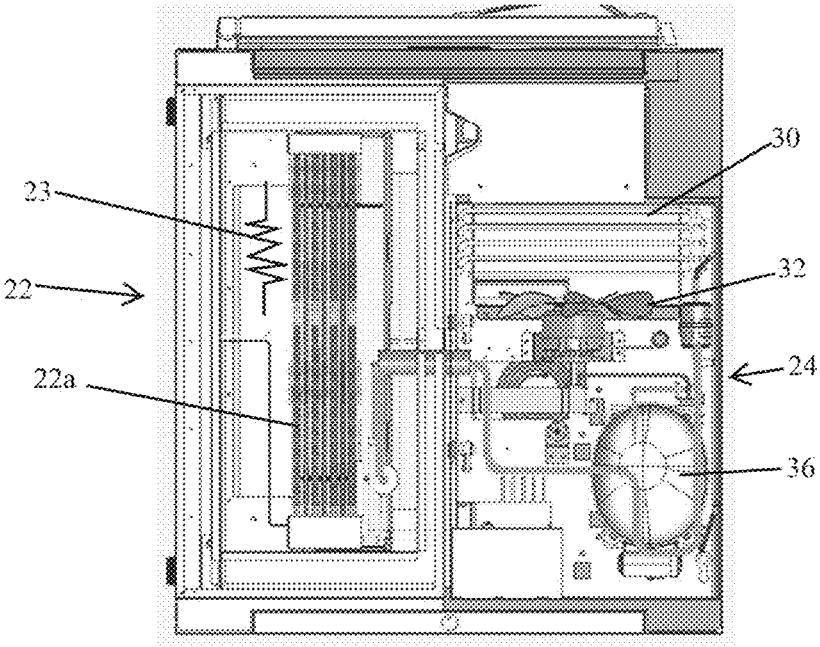
Figure 7:
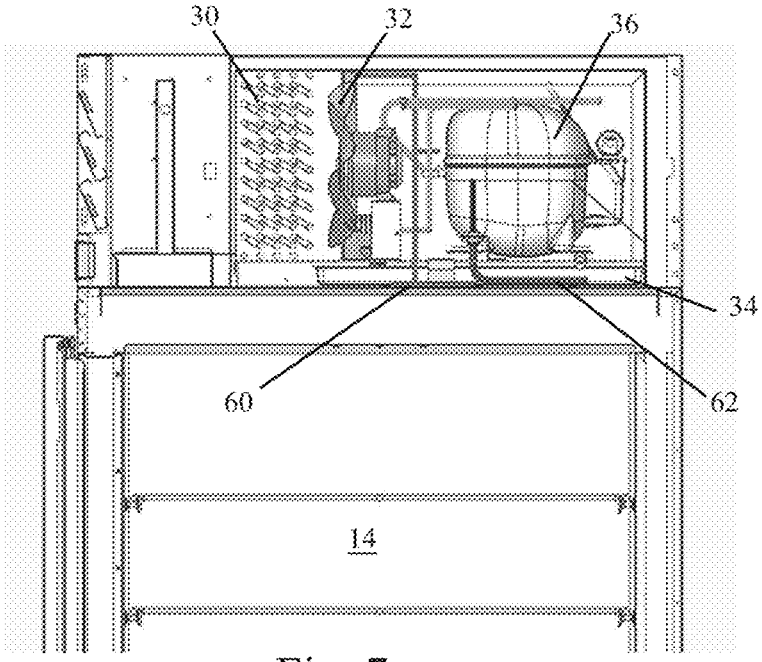
FIGS. 7 and 8 show the condenser unit of the device of FIG. 4.
Figure 8:
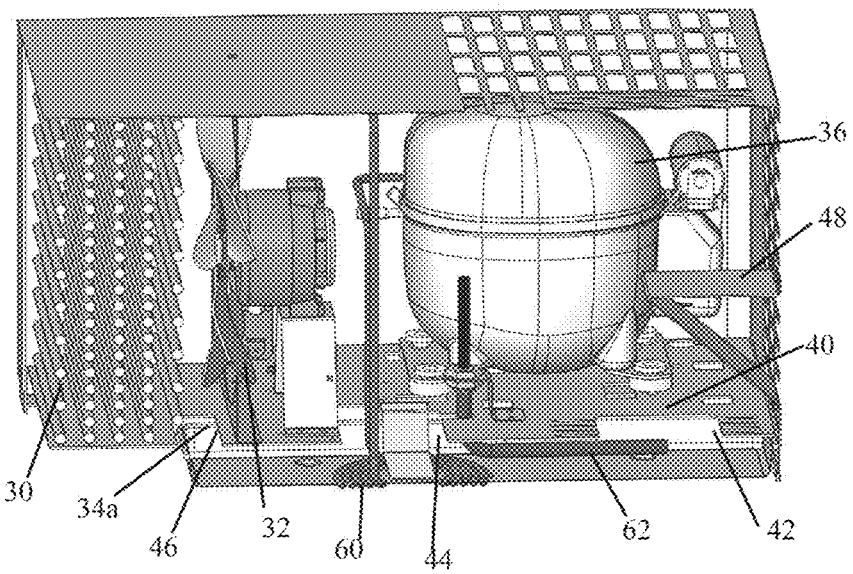

The refrigeration system 20 of the device is located at the top of the cabinet 12 and includes an evaporator unit or assembly 22 and a condenser unit or assembly 24. The evaporator unit 22 includes an evaporator coil **22*a* and an air circulation fan 22*b*, shown schematically, and a path for condensate to run to the condensate pan of the condenser unit 24. A heater 23, shown schematically, for defrosting of the evaporator coil is also provided. The condenser unit 24 includes the condenser coil 30, fan 32** and condensate pan 34, as well as the compressor 36. As best seen in FIG. 8, the floor 40 of the condenser unit includes three openings 42, 44 and 46 to the condensate pan 34. Here, the openings 42, 44 and 46 all overlie the pan 34 (in top plan view). In certain implementations, an upper edge 34*a* of the condensate pan 34 is in contact with a bottom side of the floor 40 to focus air flow through and along the pan, as will be described in further detail below.

A hot gas loop 60 is provided in the condensate pan for condensate heating, and a supplemental electric heating element 62 is also provided in the condensate pan in order to further enhance the heating of the condensate and increase the evaporation rate.

The openings 42 and 44 are located on the high-pressure side of the condenser fan 32, and the opening 46 is located on the suction side of the condenser fan 32, between the condenser 30 and the condenser fan 32. An air flow diverter 48 is provided to redirect air flow from the fan 32 down toward the opening 42, which enhances air flow down into the condensate pan 34, below the floor 40. The inclusion of the air flow opening 46 on the suction side of the fan 32 also further enhances the air flow within the pan. By way of example, the air flow opening 46 on the suction side of the condenser fan 32 may provide or define a flow area of at least four square inches (e.g., at least five square inches or at least six square inches) between the condenser pan and the suction side.

Figure 9:
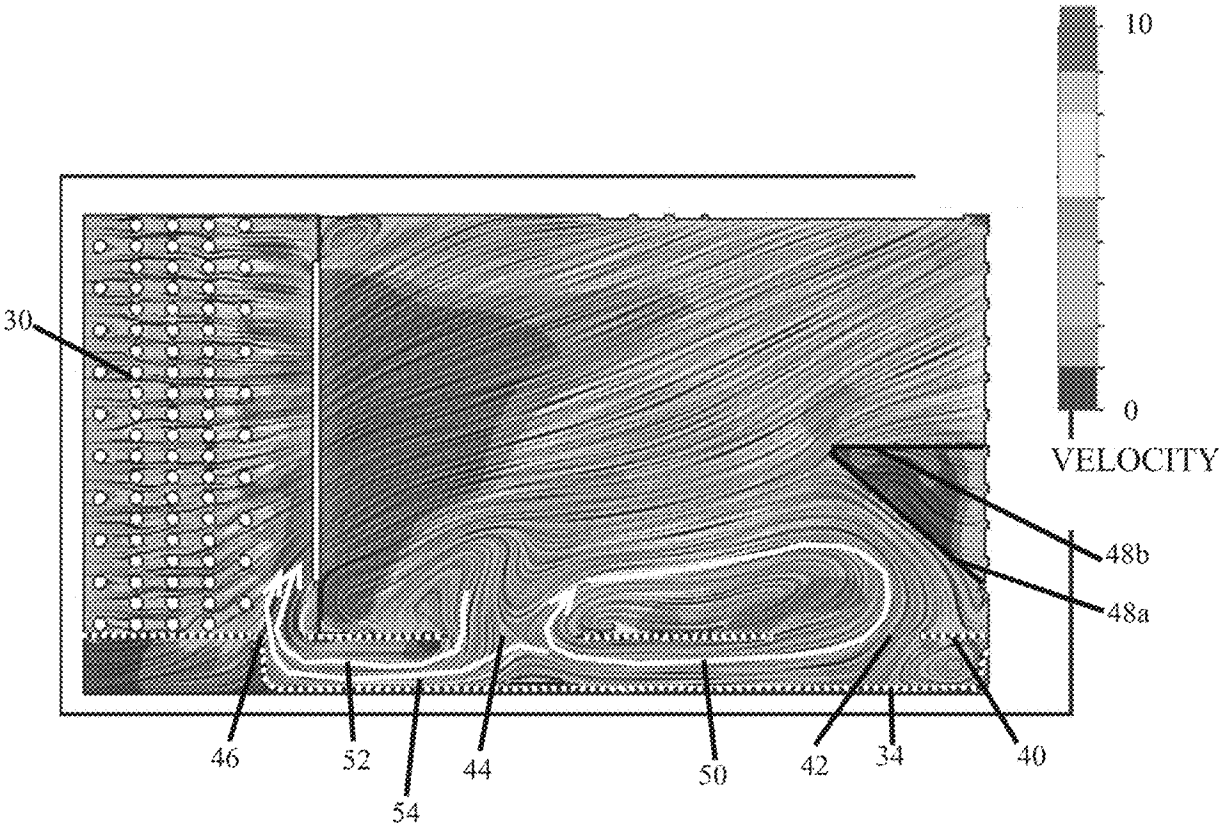
FIG. 9 shows an air flow through the condenser unit of the device of FIG. 4, in side elevation.

The overall result can be seen in the air velocity representation of FIG. 9, where a strong circulating flow is present per arrow path 50, along with a strong air flow at the end of the pan to the suction side of the fan per arrow paths 52 and 54. Paths 52 and 54 represent air flow paths from the pressure side of the condenser fan, into and through at least part of the condensate pan 34 and then to the suction side of the condenser fan. Path 50 represents a path from the pressure side of the condenser fan, into and through at least part the condensate pan 34 and then back to the pressure side of the condenser fan.

Here, the air flow diverter is in the form of a triangular baffle with a lower, downwardly angled panel 48*a* and an upper, generally horizontal panel 48*b*. The lower panel 48*a* primarily causes the redirection of air down toward the opening 42. The triangular baffle includes one or more fingers that enable the baffle to be clip mounted to openings in the housing of the condenser unit 24.

The above-described configuration of the condensate pan system improves the evaporation rate from the condensate pan both by increasing the air flow through the pan and by increasing the amount of heat that can be applied to the condensate in the pan. This assists in eliminating or reducing condensate pan overflows, which is highly desirable in refrigerated devices of this type.

With respect to air flow, in some implementations, during operation of the condenser fan 32, a volumetric air flow rate of at least 10 cubic feet per minute (CFM) (e.g., at least least 15 CFM) of air from the pressure side of the condenser fan (e.g., through openings 42 and 44), into and through or along the condensate pan 34, and then back to the suction side of the condenser fan (e.g., through opening 46) is established. Moreover, in some implementations, during operation of the condenser fan 32, a volumetric air flow rate of at least 10 CFM (e.g., at least 15 CFM) of air from the pressure side of the condenser fan, through one of the pressure side openings (e.g., 42), into and through or along the condensate pan 34 and then back through other pressure side opening (e.g., 44) to the pressure side of the condenser fan is established.

By way of example, the above structures may be included in a refrigerated device such as that described in U.S. Pat. No. 10,323,875, which is incorporated herein by reference.

It is to be clearly understood that the above description is intended by way of illustration and example only, is not intended to be taken by way of limitation, and that other changes and modifications are possible. For example, the number of openings in the condenser unit floor, on either the suction side or the pressure side, could vary. In addition, the configuration of the air flow diverter could vary.

What is claimed is:

1. A refrigerated device, comprising:

a compartment including an access door;

a refrigeration circuit for cooling the compartment, the refrigeration circuit including an evaporator coil with an associated evaporator fan and a condenser with an associated condenser fan;

a condensate pan for capturing condensate from the evaporator coil;

wherein the condensate pan is part of a condenser unit that includes the condenser and the condenser fan, with the condensate pan locate below a floor of the condenser unit;

wherein the floor includes at least one air flow opening to the condensate pan on a pressure side of the condenser fan and at least one air flow opening to the condensate pan on a suction side of the condenser fan, wherein the at least one air flow opening on the suction side of the condenser fan is located along a space between the condenser and the condenser fan, wherein, during operation of the condenser fan, at least some air that enters the condensate pan via the at least one air flow opening on the pressure side of the condenser fan flows along the condensate pan and leaves the condensate pan, to enter the space between the condenser and the condensate pan, via the at least one air flow opening on the suction side of the condenser fan;

wherein the condenser unit further includes an air flow diverter on the pressure side of the condenser fan for directing air downward toward the at least one air flow opening on the pressure side of the fan;

wherein the condenser unit further includes both a hot gas loop in the condensate pan for heating condensate and a supplemental heater in the condensate pan for heating condensate.

2. The refrigerated device of claim 1, wherein the at least one air flow opening to the condensate pan on the suction side of the condenser fan defines a flow area of at least five square inches between the condenser pan and the suction side.

3. The refrigerated device of claim 1, wherein, during operation of the condenser fan, a volumetric air flow rate of at least ten CFM of air from the pressure side of the condenser fan, into and along the condensate pan, and then back to the suction side of the condenser fan is established.

4. The refrigerated device of claim 3, wherein the at least one air flow opening on the pressure side of the condenser fan includes a first opening and a second opening spaced from the first opening, wherein, during operation of the condenser fan, a circulating volumetric air flow rate of at least ten CFM of air from the pressure side of the condenser fan, through the first opening, into the condensate pan and then back through second opening to the pressure side of the condenser fan is established.

5. The refrigerated device of claim 1, wherein the at least one air flow opening on the pressure side of the condenser fan overlies the condensate pan, wherein the at least one air flow opening on the suction side of the condenser fan overlies the condensate pan.

6. The refrigerated device of claim 5, wherein the at least one air flow opening on the suction side of the condenser fan is located between the condenser and the condenser fan.

7. The refrigerated device of claim 6, wherein an upper edge of the condensate pan is in contact with a bottom side of the floor.

8. The refrigerated device of claim 1, wherein the air flow diverter is positioned at a height such that some air moved by the condenser fan travels above the air flow diverter without being directed downward toward the at least one air flow opening on the pressure side of the condenser fan.

9. A refrigerated device, comprising:

a compartment including an access door;

a refrigeration circuit for cooling the compartment, the refrigeration circuit including an evaporator coil with an associated evaporator fan and a condenser with an associated condenser fan;

a condensate pan for capturing condensate from the evaporator coil;

wherein the condensate pan is part of a condenser unit that includes the condenser and the condenser fan, with the condensate pan locate below a floor of the condenser unit;

wherein the floor includes first and second air flow openings to the condensate pan on a pressure side of the condenser fan, wherein the second air flow opening is spaced further from the condenser fan than the first air flow opening, wherein the floor further includes a further air flow opening to the condensate pan on a suction side of the condenser fan, wherein the further air flow opening is located along a space between the condenser and the condenser fan;

wherein the condenser unit further includes an air flow diverter on the pressure side of the condenser fan, wherein the first air flow opening, the second air flow opening and the air flow diverter are positioned and configured such that, during operation of the condenser fan, air exiting the first air flow opening is directed by the air flow diverter downward toward the second air flow opening to create a circulating flow from the first air flow opening, above the floor to the second air flow opening, and through the pan back to the first air flow opening;

wherein, during operation of the condenser fan, at least some air that enters the condensate pan via the first air flow opening or the second air flow opening flows along the condensate pan and leaves the condensate pan, to enter the space between the condenser and the condensate pan, via the further air flow opening.

10. The refrigerated device of claim 9, wherein the air flow diverter is positioned at a height such that some air moved by the condenser fan travels above the air flow diverter without being directed downward toward the second air flow opening on the pressure side of the condenser fan.

* * * * *